US006644380B2

(12) United States Patent
Perich et al.

(10) Patent No.: US 6,644,380 B2
(45) Date of Patent: Nov. 11, 2003

(54) CORNER BRACKET ASSEMBLY

(75) Inventors: David C. Perich, North Canton, OH (US); Tony Bouquot, Hudson, OH (US)

(73) Assignee: Patio Enclosures, Inc., Macedonia, OH (US)

( * ) Notice: Subject to any disclaimer, the term of this patent is extended or adjusted under 35 U.S.C. 154(b) by 0 days.

(21) Appl. No.: 10/041,048

(22) Filed: Jan. 7, 2002

(65) Prior Publication Data

US 2003/0127201 A1 Jul. 10, 2003

(51) Int. Cl.[7] ..... A47G 5/00
(52) U.S. Cl. ..... 160/381; 49/425
(58) Field of Search ..... 160/381, 369, 160/371, 377, 380; 49/425; 16/97, 99, 105

(56) References Cited

U.S. PATENT DOCUMENTS

| | | | | |
|---|---|---|---|---|
| 1,852,866 A | | 4/1932 | Weitzel | |
| 3,208,109 A | * | 9/1965 | Buck | 49/425 |
| 3,299,575 A | * | 1/1967 | Du Shane | 49/425 X |
| 3,619,947 A | | 11/1971 | Burum | |
| 3,716,890 A | | 2/1973 | Benson | |
| 3,784,043 A | | 1/1974 | Presnick | |
| 4,030,160 A | | 6/1977 | Lambertz et al. | |
| 4,189,870 A | | 2/1980 | Helmick | |
| 4,397,062 A | | 8/1983 | Huang | |
| 4,502,260 A | | 3/1985 | Machler | |
| 4,570,406 A | | 2/1986 | DiFazio | |
| 4,805,262 A | | 2/1989 | Marshik | |
| 4,873,741 A | | 10/1989 | Riegelman | |
| 4,899,493 A | | 2/1990 | Baumgarten | |
| 5,119,872 A | | 6/1992 | Engebretson | |
| 5,287,655 A | | 2/1994 | Harvey | |
| 5,343,594 A | | 9/1994 | Harvey | |
| 5,894,706 A | * | 4/1999 | Herbst | 160/371 X |
| D411,018 S | | 6/1999 | Nowell | |
| 5,921,051 A | | 7/1999 | Hope | |
| 6,067,760 A | | 5/2000 | Nowell | |

FOREIGN PATENT DOCUMENTS

GB 2 161 193 A 1/1986

* cited by examiner

*Primary Examiner*—David Purol
(74) *Attorney, Agent, or Firm*—Fay, Sharpe, Fagan, Minnich & McKee, LLP

(57) ABSTRACT

A corner bracket assembly for use in an associated frame assembly is provided. The corner bracket assembly comprises a body, a first leg and second leg. The first leg extends from the body and is adapted to be connected to a first frame member of the associated frame assembly. The second leg extends from the body in a direction approximately normal to the first leg and is adapted to be connected to a second frame member of the associate frame assembly. The corner bracket assembly further comprises a roller element rotatably mounted within one of at least two axially spaced positions in at least one of the body, the first leg, and the second leg. The roller element protrudes outward a selected distance relative to at least one of the body, the first leg, and the second leg.

26 Claims, 5 Drawing Sheets

CORNER BRACKET ASSEMBLY

BACKGROUND OF THE INVENTION

The present invention relates to a corner bracket assembly. More particularly, the invention relates to a screen corner bracket assembly for use with an associated frame assembly and will be described with particular reference thereto. However, it is to be appreciated that the present invention may also be amenable for other applications.

It is well known that screen corner bracket assemblies are used to connect a plurality of elongated frame elements to form a frame assembly of a door sash, window sash, panel, or the like. It is also well known to use rollers with such frame assemblies. Typically, the rollers or roller assemblies are separate from the screen corner bracket assemblies and are installed into the corner bracket or into the adjacent attached frame member. The rollers are capable of being slidably supported within a track on an associated fixed door frame, window frame, panel frame, or the like.

Most known corner brackets include only a single location for mounting the roller. To accommodate varying installations, some corner brackets permit adjustment of the roller once mounted. However, these corner brackets are often costly to manufacture. The known adjustable corner brackets also are not as sturdy as desirable. Thus, it is desirable to provide corner bracket assemblies having non-adjustable rollers that are mountable in a plurality of predefined locations wherein the strength and integrity of the corner bracket assembly is maintained.

The present invention provides a new and improved corner bracket assembly that overcomes the foregoing difficulties and others and provides the aforementioned advantageous features.

SUMMARY OF THE INVENTION

In accordance with one aspect of the present invention, a new and improved corner bracket assembly is provided for use in an associated frame assembly.

More particularly, in accordance with this aspect of the invention, the corner bracket assembly comprises a body, a first leg, and a second leg. The first leg extends from the body and is adapted to be connected to a first frame member of the associated frame assembly. The second leg extends from the body in a direction approximately normal to the first leg is adapted to be connected to a second frame member of the associated frame assembly. A roller element is selectively rotatably mounted within one of at least two axially spaced positions in at least one of the body, the first leg, and the second leg. The roller element protrudes outward a selected distance relative to at least one of the body, the first leg, and the second leg.

According to another aspect of the present invention, a new and improved corner fastener is provided for use in forming an associated frame assembly by interconnecting, at a predetermined angle, elongated tubular members of the associated frame assembly.

More particularly, in accordance with this aspect of the invention, the corner fastener comprises a junction member and a pair of legs connected to the junction member. Each of the legs is adapted for disposition within an internal space of a respective one of the associated elongated tubular members and is of such a cross sectional area so as to substantially and securely fill the internal space of the associated elongated tubular member. The junction member is of such a configuration as to be continuous with the outer walls of the tubular members. The corner fastener further comprises a roller rotatably mounted in the junction member and two spaced mounting areas in the junction member for selectively mounting the roller.

According to still another aspect of the present invention, a corner bracket assembly is provided for use in an associated movable frame assembly.

More particularly, in accordance with this aspect of the invention, the corner bracket assembly comprises a first housing piece having upstanding annular receiving columns. A second housing piece has pins for connecting engagement with the receiving columns and defining a cavity therebetween. A roller is received within the cavity. At least two spaced tracks are defined between the first and second housing pieces for slidably receiving an axle of the roller.

According to another aspect of the invention, a new and improved corner roller arrangement is provided for at least one corner of a slidable panel of the type including a pair of parallel, elongated spaced side members defining the length of the panel and top and bottom members defining the width of the panel.

More particularly, in accordance with this aspect of the invention, the corner roller arrangement comprises a corner member including a frame and two corner keys integral therewith. The corner keys fit into respective ones of the side, top and bottom panel members whereby said panel members abut the corner member frame for providing a rigid panel frame. The corner member frame has a first side, a second side, and a longitudinal axis. The first and second sides are in substantially parallel spaced relation on either side of the longitudinal axis. The corner roller arrangement further comprises a roller disposed within the corner member frame between the first and second corner member frame sides. The roller is selectively mountable in either of a first and a second location. The two locations are spaced along the longitudinal axis.

According to another aspect of the invention, a new and improved corner bracket and roller is provided for a sliding panel.

More particularly, in accordance with this aspect of the invention, a corner bracket has integral first and second arms extending at approximately right angles and adapted for insertion into associated frame members of an associated panel. The corner bracket and roller further comprises a roller rotatably secured within the corner bracket and accessible through an aperture in the corner bracket. The corner bracket and roller further comprises at least two sets of receiving elements disposed on the corner bracket and within the aperture for positioning the roller. Each of the at least two sets of receiving elements allowing the, roller to protrude a different selected distance relative to the aperture.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENT

Figure 1:
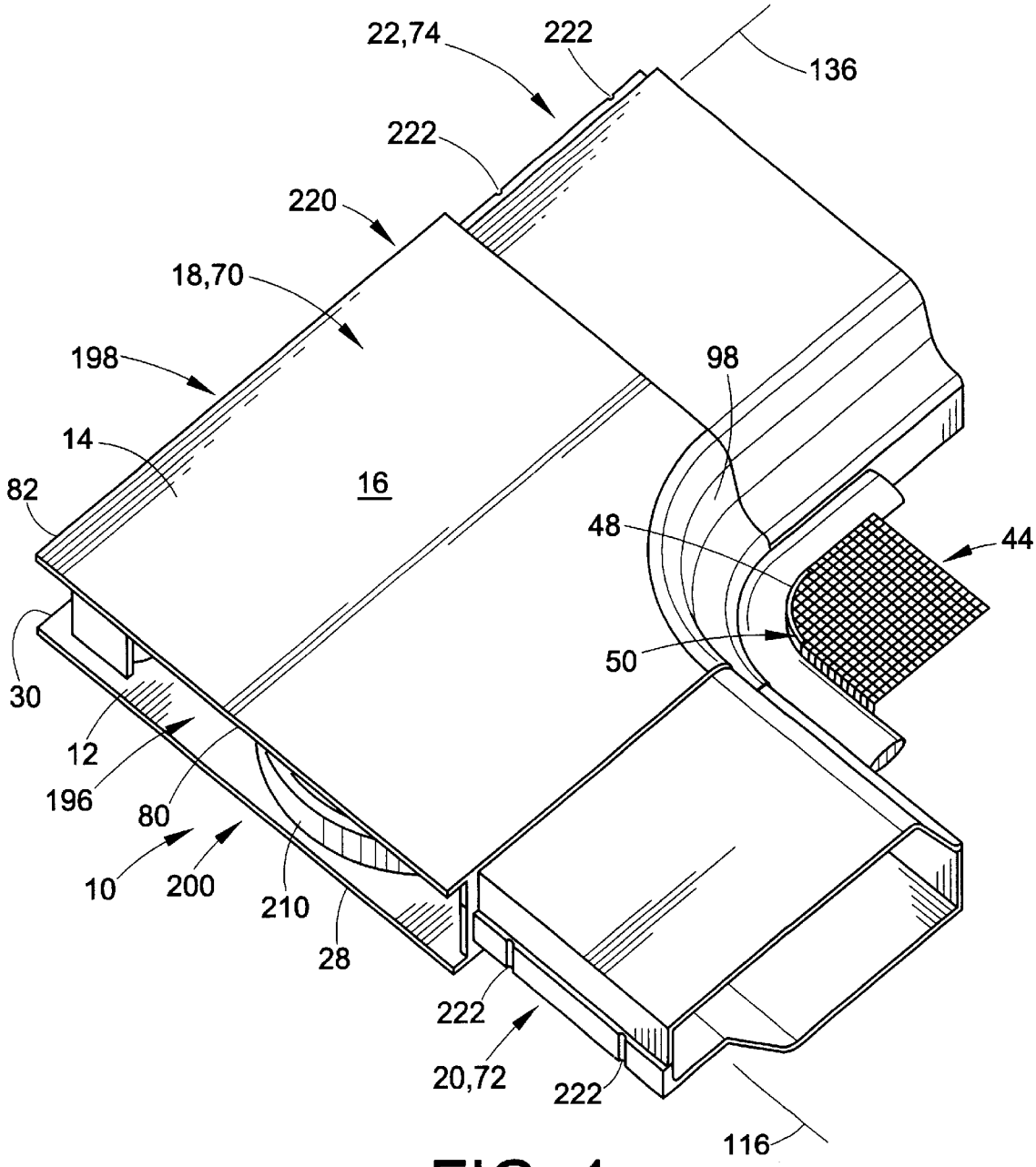
FIG. 1 is a perspective view of a corner bracket assembly according to the present invention.
Figure 2:
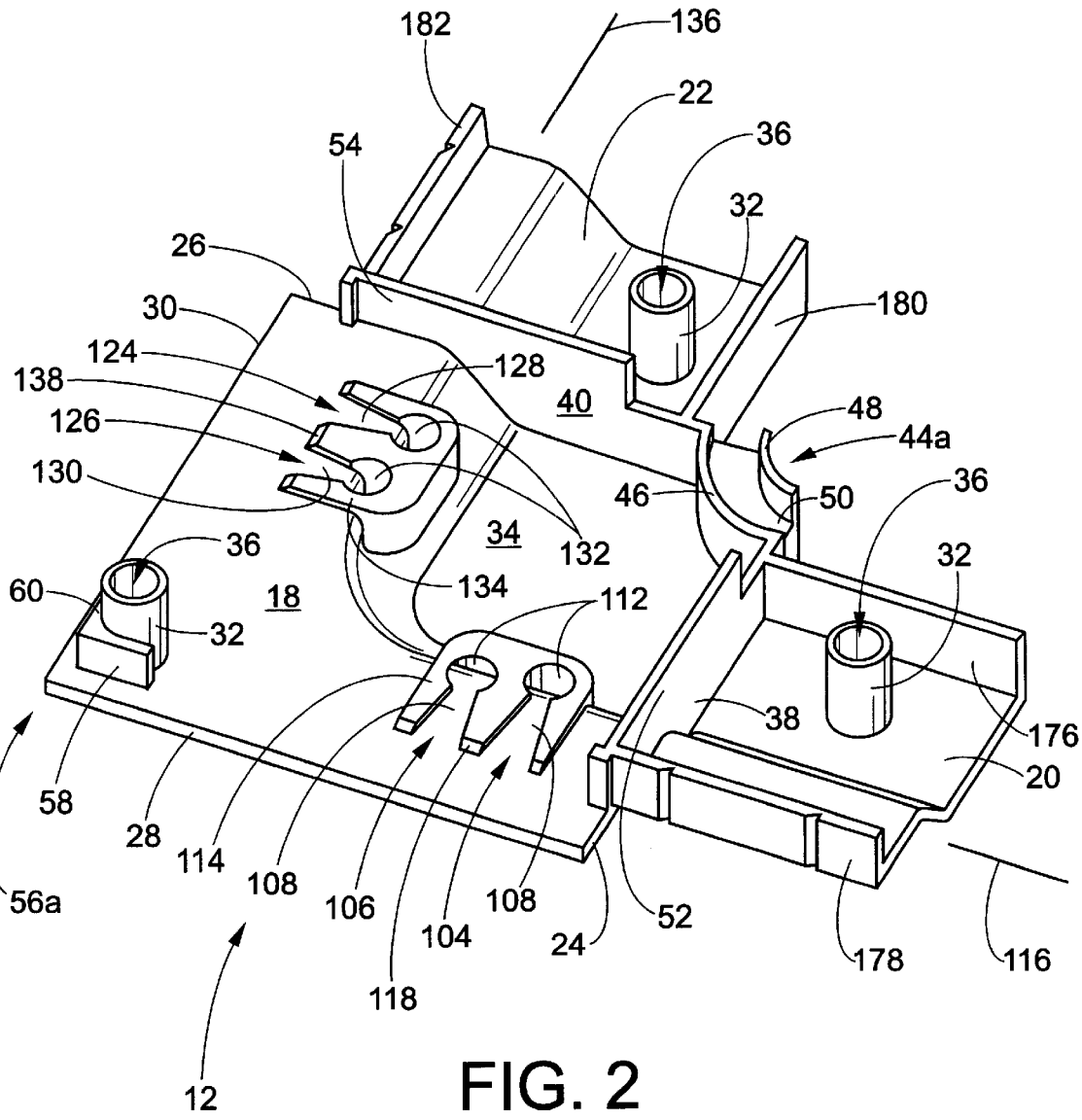
FIG. 2 is a perspective view of a first housing piece of the corner bracket assembly of FIG. 1 showing a cavity side thereof.

Referring now to the drawings wherein the showings are for purposes of illustrating the preferred embodiments of the invention only and not for purposes of limiting the same, FIG. 1 shows a corner bracket assembly 10 comprising a first housing piece 12 and a second, opposing housing piece 14 which together form a housing 16. With reference to FIG. 2, the first housing piece 12 comprises a body portion 18, a first leg portion 20, and a second leg portion 22. The body portion 18 is generally rectangular-shaped having a first side 24, a second side 26, a third side 28, and a fourth side 30. The first leg portion 20 extends from the first side 24 of the body portion 18. The second leg portion 22 extends from the second side 26 of the body portion 16 in a direction approximately normal relative to the first leg portion 20. A plurality of receiving columns 32 extend from a cavity side 34 of the first housing piece 12. Each of the plurality of receiving columns 32 includes a socket 36 opening from a distal end thereof.

Along a substantial portion of the first side 24, a first leg wall 38 extends away from the body portion 18 at an angle approximately normal to a general plane of the body portion 18. The first leg wall 38 separates the first leg portion 20 from the body portion 18. Along a substantial portion of the second side 26, a second leg wall 40 extends away from the body portion 18 at an angle approximately normal to the general plane of the body portion 18. Similar to the first leg wall 38, the second leg wall 40 separates the second leg portion 22 from the body portion 18.

Adjacent a first housing piece interior corner junction 44*a*, a curved wall 46 extends upward from the body portion 18 connecting between the first and second leg walls 38,40. The interior corner junction 44*a* may generally be characterized as the area where the first and second leg portions 20,22 and the first and second sides 24,26 converge. A finger 48 extends at an angle approximately normal to the general plane of the body portion 18 near the interior corner junction 44*a*. A groove 50 is partially defined by the finger 48 and the curved wall 46. Portions 52,54 of the first and second leg walls 38,40 extend a distance away from the body portion 18 greater than the remaining portions of the leg walls 38,40.

Diagonally opposite to the interior junction 44*a*, a first housing piece exterior corner junction 56*a* is defined at or near the intersection of the third and fourth sides 28,30. A pair of column walls 58,60 form an L-shaped brace adjacent to the exterior corner junction 56*a* and one of the columns 36. Each of the walls 58,60 is parallel to a respective edge 28 and 30 as illustrated. The walls 58,60 extend in a direction approximately normal to the general plane of the body portion 18 but a distance away from the body portion 18 that is less than the columns 36.

Figure 3:
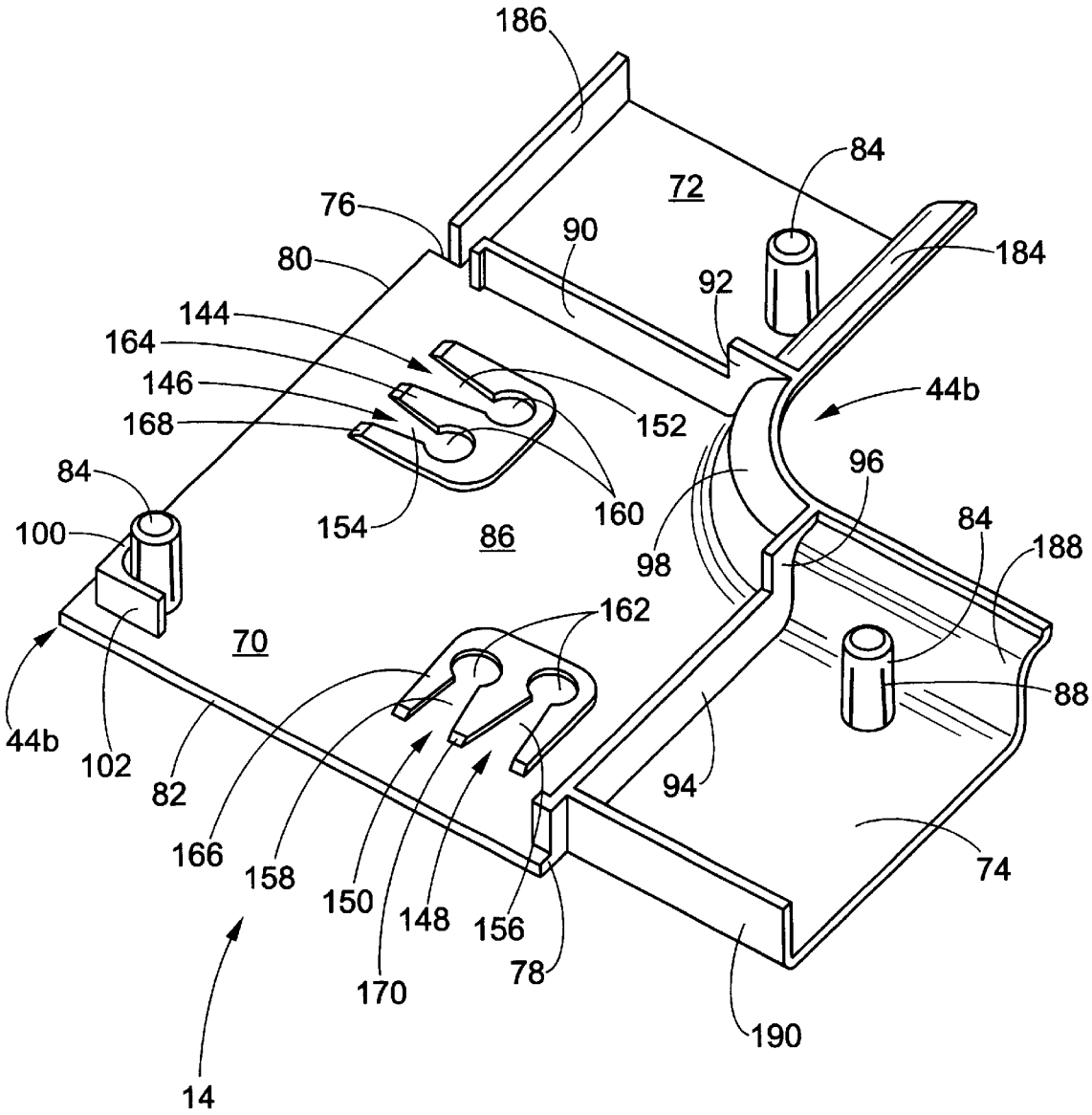
FIG. 3 is a perspective view of a second housing piece of the corner bracket assembly of FIG. 1 showing a cavity side thereof.

With reference to FIG. 3, the second housing piece 14 comprises a body portion 70, a first leg portion 72, and a second leg portion 74, similar to the first housing piece 12. Again, the body portion 34 is generally rectangular-shaped and it includes a first side 76, a second side 78, a third side 80, and a fourth side 82. The first leg portion 72 extends from the first side 76 of the body portion 70. The second leg portion 74 extends from the second side 78 of the body portion 70 in a direction approximately normal relative to the first leg portion 72. A plurality of coupling pins 84 extend from a cavity side 86 of the second housing piece 14. The coupling pins 84 each include a plurality of longitudinally extending ribs 88.

Along a substantial portion of the first side 76, a first leg wall 90 extends away from the body portion 70 in a direction approximately normal to a general plane of the body portion 70. The first leg wall 90 separates the first leg portion 72 from the body portion 70. The first leg wall 90 includes a raised portion 92 adjacent an interior corner junction 44*b* of the second housing piece 14. Like the interior corner junction 44*a* of the first housing piece 12, the interior corner junction 44*b* may generally be characterized as the area where the first and second leg portions 72,74 and the first end second sides 76,78 converge.

Along a substantial portion of the second side 78, a second leg wall 94 extends away from the body portion 70 in a direction approximately normal to the general plane of the body portion 70. The second leg wall 94 separates the second leg portion 74 from the body portion 70. Like the first leg wall 90, the second leg wall 94 includes a raised portion 96 adjacent the interior corner junction 44*b*.

Connected between the first leg wall 90 and the second leg wall 94, a rounded, curved wall 98 is disposed adjacent the interior corner junction 44*b*. The height of the wall 98 is about the same as the height of the raised portions 92,96. As will be described in more detail below, the raised portions 52,54 are offset relative to the raised portions 92,96 and the respective heights of the walls 46 and 98 are optimal for mating engagement.

Diagonally opposite to the interior corner junction 44*b*, a second housing piece exterior corner junction 56*b* is defined at or near the intersection of the third and fourth sides 80,82. A pair of column walls 100,102 form an L-shaped brace adjacent to the exterior corner portion 56*b* and one of the coupling pins 84. Each of the walls 100,102 is parallel to respective side 80 and 82 as illustrated. The walls 100,102 extend in a direction approximately normal to the general plane of the body portion 70 but at a distance from the body portion 70 that is less than the coupling pins 84.

With reference to FIG. 2, the first housing piece 12 includes a pair of channels 104,106 adjacent to the first leg portion 20. The channel 104 includes an insertion section 108 that is open toward the adjacent first side 28. Likewise, the channel 106 includes an insertion section 110 that is open toward the adjacent first side 28. Farther inward relative to the edge 28, each of the channels 104,106 includes an identical circular retention or mounting area 112. Each of the insertion sections 108,110 narrows or tapers inward along its length from the open end to the circular retention area 112. The insertion section 108 is longer in length than the insertion section 110 and, thus, the channel 104 is longer in length than the channel 106.

The channels 104,106 are defined by guide members or receiving elements such as ribs 114. The ribs extend away from the cavity side 34 of the first housing piece 12. As shown in FIG. 2, each of the channels 104,106 is positioned at a unique location along a longitudinal axis 116 of the first leg portion 20 relative to the first side 24. For example, the channel 104 is located closer to the first side 24 along the axis 116 than the channel 106. The insertion sections 108, 110 begin, at their respective open ends, at the same location relative to the adjacent third side 28 but extend to a discrete, variant location relative to the side 28. Thus, each of the circular retention areas 110 of the channels 104,106 are located at varying positions relative to the adjacent third side 28. The guide members 112 include tapered or chamfered sections 118 at their distal ends which are adjacent the third side 28.

A second pair of channels 124,126 are disposed on the first housing piece 12 adjacent the second leg portion 22. In many respects, the second pair of channels 124,126 are like the first pair of channels 104,106. The channel 124 includes an insertion section 128 that is open toward the fourth side 30. The channel 126 also includes an insertion section 130 that is open toward the fourth side 30. Both channels 124,126 include identical circular retention or mounting areas 132 located farther inward relative to the side 30. Each of the insertion sections 128,130 narrows or tapers inward along its length from the open end to the circular retention area 132. The insertion section 128 is longer in length than the insertion section 130 and, thus, the channel 124 is longer in length than the channel 126.

The channels 124,126 are defined by guide members or receiving elements such as ribs 134 similar to the guide members 114. Each of the channels 124,126 is positioned at a unique location along a longitudinal axis 136 of the second leg portion 22 relative to the second side 26. For example, the channel 124 is located closer to the second side 26 along the axis 136 than the channel 126. The insertion sections 128,130 begin, at their respective open ends, at the same location relative to the adjacent fourth side 30 and extend to a discrete, variant location relative to the side 30. Thus, each of the circular retention areas 132 of the channels 126,128 are located at varying positions relative to the adjacent fourth side 30. Also like the guide members 112, the guide members 134 include tapered or chamfered sections 138 at their distal ends which are adjacent the fourth side 30.

With reference to FIG. 3, the second housing piece 14 includes a pair of channels 144,146 adjacent to the first leg portion 72 and a pair of channels 148,150 adjacent to the second leg portion 74. In many respects the channels 144–150 of the second housing piece 14 are like the first housing piece channels 104,106,124,126. The channels 144, 146 include insertion sections 152,154 that are open toward the third side 80 and the channels 148,150 include insertion sections 156,158 that are open toward the fourth side 82. The channels 144–150 include retention areas 160,162 that are located farther inward than the respective insertion sections 152–158 relative to the respective sides 80,82. Each of the insertion sections 152–158 narrows or tapers inward along its length from the open end toward the retention areas 160,162. The insertion sections 152,156 are longer in length than the insertion sections 154,158 and, accordingly, the channels 144,148 are longer in length than the channels 146,150.

Like the first housing piece channels 104,106,124,126, the channels 144,146 are defined by guide members 164, also referred to herein as receiving elements or ribs, and the channels 148,150 are defined by like receiving elements 166. Each of the channels 144,146 are positioned at a location relative to the first side 76 that corresponds to the distance between the channels 104,106 relative to the first side 24. Each of the channels 148,150 are positioned at a location relative to the second side 78 that corresponds to the distance between the channels 124,126 relative to the second side 26.

In a like manner, the insertion sections 152,154 begin and end at points on the second housing piece 14 relative to the third side 80 corresponding to the beginning and ending points of the insertion sections 108,110 of the first housing piece relative to the third side 28. The insertion sections 156,158 begin and end at points on the second housing piece 14 relative to the fourth side 82 corresponding to the beginning and ending points of the insertion sections 128, 130 of the first housing piece relative to the fourth side 30. The retention areas 160,162 are located immediately inward of the insertion sections 152–158 from respective sides 80,82. The guide members 164,166 include tapered or chamfered sections 168,170 at their respective distal ends which are adjacent to respective third and fourth sides 80,82.

With reference to FIG. 2, the first leg portion 20 includes an interior leg wall 176 adjacent the interior corner junction 44*a* and an exterior leg wall 178 adjacent the third side 28. Likewise, the second leg portion 22 includes an interior leg wall 180 and an exterior leg wall 182. With reference to FIG. 3, the first leg portion 72 includes an interior leg wall 184 adjacent the interior corner junction 44b and an exterior leg wall 186 adjacent the third side 80. Likewise, the second leg portion 74 includes an interior leg wall 188 and an exterior leg wall 190.

With reference to FIG. 1, the first housing piece 12 connects to a second housing piece 14. More specifically, the first housing piece walls 38,40,46,176–182 (FIG. 2) abuttingly engage the second housing piece walls 90,94,98, 184–190 (FIG. 3). To align the housing pieces 12,14, the coupling pins 84 of the second housing piece 14 are inserted into the sockets 36 of the receiving columns 32 of the first housing piece 12. Such connection means provide structural integrity and securely connect the housing pieces 12, 14 together. The longitudinal ribs 88 of the coupling pins 84 securely lock the pins 84 within their respective sockets 36, via a friction fit.

When connected together, the housing pieces 12,14 define a cavity therebetween. Together, the first and second housing pieces 12,14 comprise a body or junction member 18,70, a first leg 20,72, and a second leg 22,74. A first leg aperture 196 is defined in the body 18,70 adjacent the first leg 20,72 and adjacent the first sides 28,80. More specifically, with additional reference to FIGS. 2 and 3, the first leg aperture 196 is defined by the first leg walls 38, 90, the column walls 58, 100, and the cavity sides 34, 86. A second leg aperture 198, similar to the first leg aperture 196, is defined in the body 18,70 adjacent the second leg 22,74 and adjacent the second sides 30,82. More specifically, the second leg aperture 198 is defined by the second leg walls 40,94, the column walls 60,102, and the cavity sides 24,86.

Figure 4:
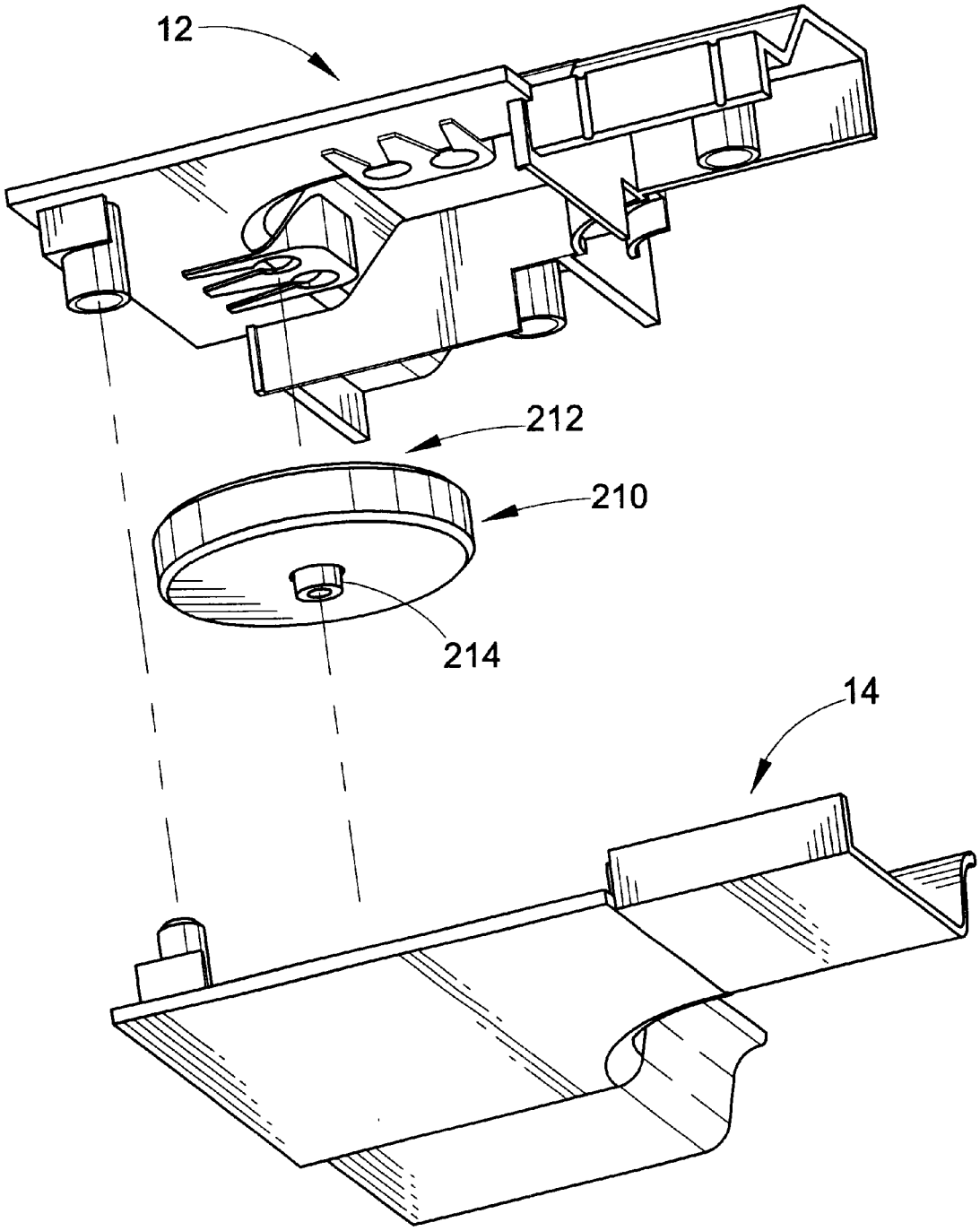
FIG. 4 is an expanded perspective view of the corner bracket assembly of FIG. 1.
Figure 5:
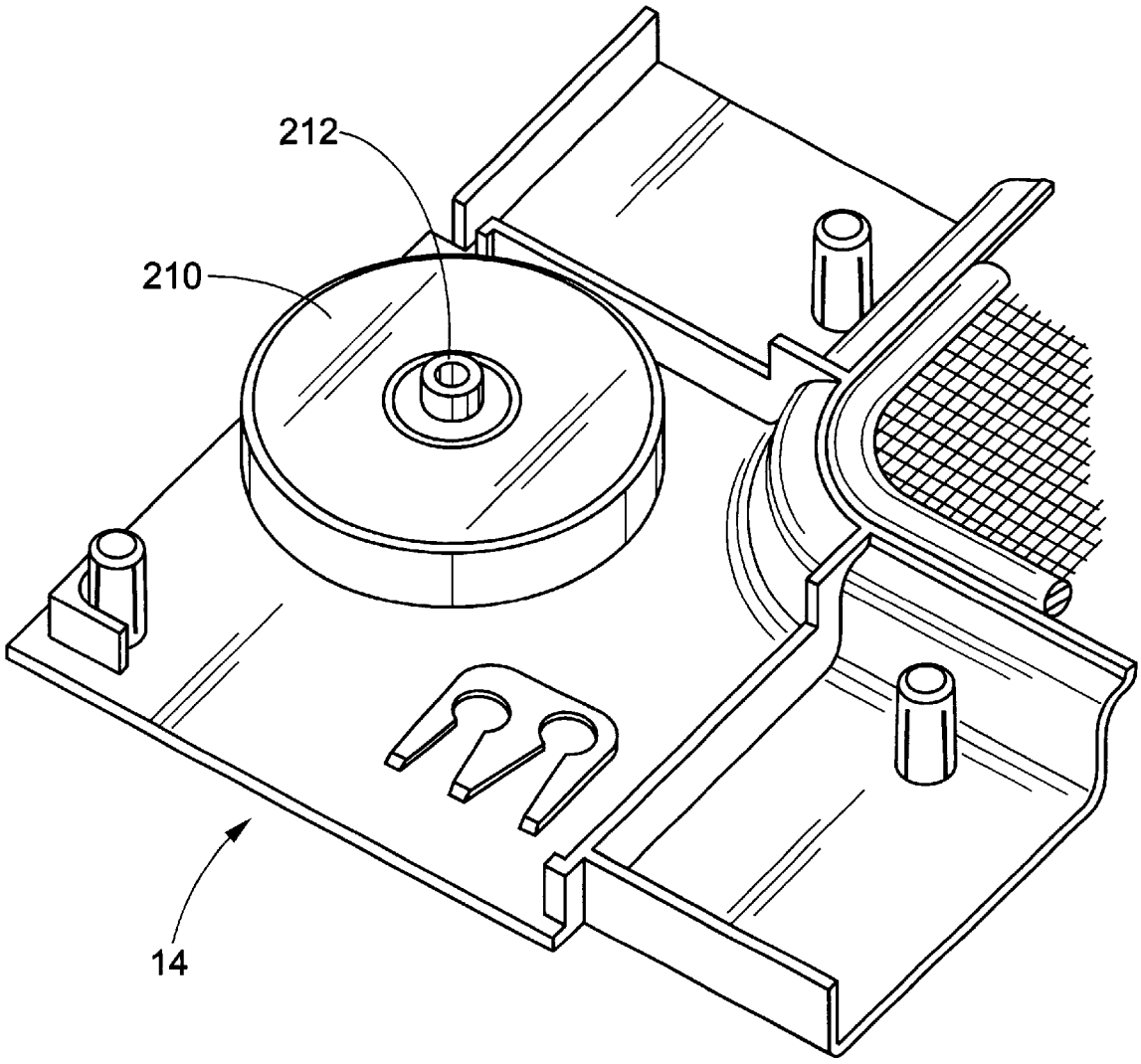
FIG. 5 is a perspective view of the corner bracket assembly of FIG. 1 showing a first housing piece removed and a roller mounted adjacent a second leg of the corner bracket assembly.

Within the first leg aperture 196, a pair of first mounting areas 200 are provided. In the embodiment illustrated, the first mounting areas 200 comprise two discrete guide elements or tracks. A first track comprises the channel 104 of the first housing piece 12 and the channel 144 of the second housing piece 14. A second track comprises the channel 106 of the first housing piece 12 and the channel 146 of the second housing piece 14. Each of the tracks 104,144 and 106,146 is adapted to receive a roller element 210. With additional reference to FIGS. 4 and 5, the roller element 210 comprises a wheel including a pair of axle stubs 212,214 located on either side of the roller element. The axle stubs 212,214 may be slidably received within a selected first track 104,144 or second track 106,146. The location of the tracks 104,144 and 106,146 within the first aperture 196 allows for the roller element 210 to be positioned at two distinct and nonadjustable positions along the longitudinal axis 116. More specifically, the roller element may be selectively positioned in one of two axially spaced positions or locations along the longitudinal axis 116.

When the roller element 210 is positioned within a selected track, the axle stubs 212,214 are slidably positioned inward away from the third sides 28,80 and into the respective track's circular retention area 112,132. Thus, when the roller element 210 is positioned within a selected track 104,144 or 106,146, the position of the roller will be varied relative to the sides 28,80 and, therefore, the degree of outward position of the roller element 210 will vary depending upon which track is selected.

With reference back to FIG. 1, a second pair of mounting areas 220 are located within the second leg aperture 198. The second mounting areas comprise two discrete guide elements or tracks. A first track comprises the channel 128 of the first housing piece 12 and the channel 148 of the second housing piece 14. A second track comprises the channel 126 of the first housing piece 12 and the channel 150 of the second housing piece 14. Like the tracks of the first mounting area 200, the tracks of the second mounting area 220 allow the roller element 210 to be selectively positioned at one of two axially spaced positions or locations along the longitudinal axis 136. Depending upon which track of the second mounting area 220 is selected, the degree of outward protrusion of the roller element 210 will vary. For example, if the first track 124,148 is selected, the degree of outward protrusion by the roller element 210 will be less than if the second track 126,150 is selected.

It should be apparent that the number of tracks provided in either of the first aperture 196 or the second aperture 198 may vary and is not limited to two tracks. Moreover, the degree of outward protrusion provided by each track may vary from that which is illustrated. Thus, the embodiment illustrated shows two mounting areas each having two tracks. Alternate embodiments may employ any number of tracks within either the first aperture 196 and/or the second aperture 198.

With continued reference to FIG. 1, the groove 50 is totally defined by the finger 48, the curved wall 46 (FIG. 2), and the rounded, curved wall 98. The groove 50 provides a securing means for fastening an associated panel, screen or the like to the interior corner junction 44 of the corner bracket assembly 10. Specifically, the finger and groove arrangement illustrated is capable of receiving a rubber strip, spline or gasket for fastening a screen or the like into the interior corner junction 44. This permits the fastened device, such as a screen, to be taut against the corner bracket assembly 10.

The corner bracket assembly 10 can be used with a frame assembly comprising a plurality of elongated frame or tubular members. The frame assembly can be that of a door, window, panel or the like. The elongated members generally have an internal cross section that interconnects with the exterior cross sections of the legs 22,72, and 22,74. The first and second legs 20,72 include angled notches 222 for securely gripping internal cross section surfaces of the elongated members. The frame members include frame grooves that are contiguous with the groove 50.

As is well known in the art, the roller or roller element 210 is mounted within an associated track that lies beneath the door, window or similar panel. Thus, the associated track in conjunction with the selected track of the corner bracket assembly 10 rotatably secures the roller element 210 in position. The varying mounting positions of the corner bracket assembly allow for a selective degree of protrusion of the roller element 210. This permits the corner bracket assembly 10 to be used in various door or window frame arrangements wherein the frame may be slightly misaligned. For example, if the door or window frame sash is not installed in a straight manner, the varying axial positions allow the door or window to be slightly adjusted via different roller positions. Further, mounting the roller 210 in the second set of tracks on the corner bracket assembly 10 permits the corner bracket assembly 10 to be used in a variety of applications without regard to the specific corner of which the rolling capability is desired. It should also be noted that the corner bracket assembly herein described can be used without the roller element 210 where a simple corner bracket is desired.

The housing pieces 12,14 of the corner bracket assembly 10 may be injection molded of a conventional plastic material as is known in the art. However, it should be appreciated that other materials may be used to form the housing pieces 12 and 14.

The invention has been described with reference to the preferred embodiment. Obviously, modifications and alterations will occur to other upon reading and understanding the preceding detailed description. It is intended that the invention be construed as including all such modifications and alterations insofar as they are within the scope of the appended claims or the equivalents thereof.

Having thus described the preferred embodiments, the invention is now claimed to be:

1. A corner bracket assembly for use in an associated frame assembly comprising:

a body;

a first leg extending from the body and adapted to be connected to a first frame member of the associated frame assembly;

a second leg extending from the body in a direction approximately normal to the first leg and adapted to be connected to a second frame member of the associated frame assembly;

a hooked finger is disposed at an interior corner junction of the first and second legs for receiving a portion of an associated panel member and preventing said portion from pulling away from said interior corner junction; and a roller element selectively rotatably mounted within at least two axially spaced positions in at least one of the body, the first leg, and the second leg, the roller element protruding outward a selected distance relative to at least one of the body, the first leg, and the second leg.

2. The corner bracket assembly of claim 1 wherein the at least two axially spaced positions are disposed in at least one aperture of the body.

3. The corner bracket assembly of claim 1 wherein the finger and a portion of the body together form a groove that is contiguous with grooves on the first and second frame members of the associated frame assembly.

4. The corner bracket assembly of claim 1 wherein each of the at least two axially spaced positions varies the degree of outward protrusion by the roller elements in relation to the body.

5. A corner fastener for use in forming an associated frame assembly by interconnecting, at a predetermined angle, elongated tubular members of the associated frame assembly, the corner fastener comprising:

a junction member;

a pair of legs connected to the junction member, each of the legs being adapted for disposition within an internal space of a respective one of the associated elongated tubular members and having a cross sectional area so as to substantially and securely fill the internal space of the associated elongated tubular members, the junction member being of such configuration as to be contiguous with the outer walls of the tubular members;

a roller rotatably mounted in the junction member; and two spaced mounting areas in the junction member for selectively mounting the roller.

6. The corner fastener of claim 5 wherein said two mounting areas are located adjacent to one of the pair of legs.

7. The corner fastener of claim 6 further comprising at least a third mounting area in the junction, said third mounting area being located adjacent another of the pair of legs.

8. The corner fastener of claim 5 further comprising a finger located near an interior corner of the junction member for securing a portion of an associated panel to the corner fastener.

9. The corner fastener of claim 5 wherein each of the two spaced mounting areas is defined by a discrete guide element.

10. The corner fastener of claim 9 wherein the roller comprises axle stubs and the guide element comprises a pair of channels that selectively receives axle stubs of the roller.

11. The corner fastener of claim 10 wherein the pair of channels are defined by ribs located on interior sides of the junction member.

12. The corner fastener of claim 10 wherein each of the channels are open to an exterior edge of the corner fastener allowing for insertion of the roller and include a circular retention area for maintaining the roller in position.

13. A corner bracket assembly for use in an associated movable frame assembly comprising:

a first housing piece having receiving columns;

a second housing piece having pins for connecting engagement with the receiving columns and defining a cavity therebetween;

a roller received within the cavity; and at least two spaced tracks defined on inside surfaces of the first and second housing pieces for slidably receiving an axle of the roller.

14. The corner bracket assembly of claim 13 wherein the first and second housing pieces comprise a plastic material.

15. The corner bracket assembly of claim 13 wherein the pins include ribs for,secure engagement within sockets defined in the receiving columns.

16. The corner bracket assembly of claim 13 wherein the at least two spaced tracks enable the roller to protrude differing amounts from the cavity.

17. The corner bracket assembly of claim 13 wherein the at least two spaced tracks are located adjacent one surface of the corner bracket assembly and further comprising at least a third track located adjacent another surface of the corner bracket assembly.

18. The corner bracket assembly of claim 13 wherein at least two spaced tracks each include an insertion section and a circular mounting section for retaining the roller.

19. The corner bracket assembly of claim 13 wherein each of the at least two spaced tracks includes guide members mounted on at least one of the first and second housing pieces and protruding into the cavity for engagement with the axle of the roller.

20. A corner roller arrangement for at least one corner of a slidable panel of the type including a pair of parallel, elongated spaced side members defining the length of the panel and top and bottom members defining the width of the panel, said corner roller arrangement comprising:

a corner member including a frame and two corner keys integral therewith, the corner keys fitting into respective ones of the side, top and bottom panel members whereby said panel members abut the corner member frame for providing a rigid panel frame, the corner member frame having a first side, a second side and a longitudinal axis, the first and second sides being in substantially parallel spaced relation on either side of the longitudinal axis; and a roller disposed within the corner member frame between the first and second corner member frame sides, the roller being selectively mountable in one of a first and a second set of locations, said first set of locations being spaced along the longitudinal axis and said second set of locations being spaced along another axis normal to said longitudinal axis.

21. The corner roller arrangement of claim 20 wherein the first and second corner member frame sides each include guide members that define the first and second locations.

22. The corner roller arrangement of claim 20 wherein the corner member further includes a securing means for attaching a screen to an interior corner junction of the corner member.

23. The corner roller arrangement of the claim 20 wherein the first and second locations are positioned on a first exterior edge adjacent an exterior corner junction.

24. A corner bracket and roller for a sliding panel comprising:

a corner bracket having integral first and second arms extending at approximately right angles and adapted for insertion into associated frame members of an associated panel;

a finger and groove arrangement located between the first and second arms for receiving a portion of an associated screen;

a roller rotatably secured within the corner bracket and accessible through an aperture in the corner bracket; and at least two sets of receiving elements disposed on the corner bracket and within the aperture for positioning the roller, each of the at least two sets of receiving elements allowing the roller to protrude a different selected distance relative to the aperture.

25. The corner bracket and roller assembly of claim 24 wherein the corner bracket includes a second aperture spaced from the first aperture.

26. The corner bracket and roller of claim 25 further comprising:

another set of receiving elements disposed on the corner bracket and within the second aperture for allowing the roller to protrude a select distance relative to the second aperture.

* * * * *